US009657728B2

(12) United States Patent
Oomori

(10) Patent No.: US 9,657,728 B2
(45) Date of Patent: May 23, 2017

(54) SEMISPHERICAL SHOE FOR SWASH PLATE COMPRESSOR AND SWASH PLATE COMPRESSOR

(71) Applicant: NTN CORPORATION, Osaka (JP)

(72) Inventor: Akihiro Oomori, Mie (JP)

(73) Assignee: NTN CORPORATION, Osaka (JP)

( * ) Notice: Subject to any disclaimer, the term of this patent is extended or adjusted under 35 U.S.C. 154(b) by 39 days.

(21) Appl. No.: 14/783,841

(22) PCT Filed: Apr. 4, 2014

(86) PCT No.: PCT/JP2014/059977

§ 371 (c)(1),
(2) Date: Oct. 9, 2015

(87) PCT Pub. No.: WO2014/168088

PCT Pub. Date: Oct. 16, 2014

(65) Prior Publication Data

US 2016/0053751 A1 Feb. 25, 2016

(30) Foreign Application Priority Data

Apr. 10, 2013 (JP) ..... 2013-081740

(51) Int. Cl.
*F01B 31/10* (2006.01)
*F04B 27/08* (2006.01)
*F04B 27/10* (2006.01)

(52) U.S. Cl.
CPC ..... *F04B 27/0886* (2013.01); *F04B 27/0891* (2013.01); *F04B 27/1054* (2013.01); *F05C 2251/14* (2013.01)

(58) Field of Classification Search
CPC ..... F04B 27/0886; F04B 39/0215; F05C 2251/14
See application file for complete search history.

(56) References Cited

U.S. PATENT DOCUMENTS 1,964,671 A * 6/1934 Nesbitt ..... F16C 33/10 92/155
7,156,014 B2 * 1/2007 Sugioka ..... F04B 27/0886 92/155

(Continued)

FOREIGN PATENT DOCUMENTS

CN 1410676 A 4/2003
CN 1417251 A 5/2003

(Continued)

OTHER PUBLICATIONS

International Search Report dated Jul. 1, 2014.

*Primary Examiner* — Michael Leslie
(74) *Attorney, Agent, or Firm* — Hedman & Costigan, P.C.; James V. Costigan; Kathleen A. Costigan

(57) ABSTRACT

It is an object of the present invention to provide a semispherical shoe which can be prevented from being subjected to seizure even in a dry lubrication state in which there is no lubricating oil at the start time of an operation, does not deteriorate in its lubricating property owing to frictional heating, and ensures sufficient durability and a swash plate compressor in which a lubricating film is not formed on a sliding contact surface of a swash plate owing to the use of the semispherical shoe. A semispherical shoe (4) makes sliding contact with the swash plate of the swash plate compressor. A surface of a planar part (4*b*) which makes sliding contact with the swash plate consists of a resin layer (10). A surface of a spherical part (4*b*) consists of a base material of the semispherical shoe. In viewing the surface of the planar part divided into three parts consisting of a central part (10*a*), an outer edge part (10*c*), and an intermediate part (10*b*) interposed between the central part (10*a*) and the outer edge part (10*c*) in a direction vertical to the surface of the planar part, an annular belt portion (10*d*) whose layer (Continued)

thickness is larger than that of each of the central part (10*a*) and the outer edge part (10*c*) is formed inside the intermediate part (10*a*).

7 Claims, 3 Drawing Sheets

(56) References Cited

U.S. PATENT DOCUMENTS

| | | | |
|---|---|---|---|
| 2003/0024380 | A1 | 2/2003 | Shimo |
| 2003/0089223 | A1 | 5/2003 | Sugioka |
| 2004/0261611 | A1 | 12/2004 | Sugioka |
| 2009/0197375 | A1 | 8/2009 | Kajiwara |

FOREIGN PATENT DOCUMENTS

| | | | |
|---|---|---|---|
| CN | 1573093 | A | 6/2004 |
| CN | 102652058 | A | 8/2012 |
| EP | 1310674 | A2 | 5/2003 |
| EP | 1489261 | A1 | 12/2004 |
| JP | 2002-039062 | A | 2/2002 |
| JP | 2002-089438 | A | 3/2002 |
| JP | 2002-180964 | A | 6/2002 |
| JP | 2003-049766 | A | 2/2003 |
| JP | 2003-138287 | A | 5/2003 |
| JP | 2005-030376 | A | 2/2005 |
| JP | 2008-138545 | A | 6/2008 |
| JP | 2009-182159 | A | 8/2009 |
| JP | 2011-121306 | A | 6/2011 |
| KR | 10-2003-0038344 | A | 5/2003 |
| KR | 10-0594335 | B1 | 6/2006 |
| WO | 2011/071102 | A1 | 6/2011 |

* cited by examiner

SEMISPHERICAL SHOE FOR SWASH PLATE COMPRESSOR AND SWASH PLATE COMPRESSOR

TECHNICAL FIELD

The present invention relates to a swash plate compressor for use in an air conditioner and the like and an approximately semispherical shoe, interposed between a swash plate and a piston, for converting a rotational motion of the swash plate into a reciprocating motion of the piston.

BACKGROUND ART

The swash plate compressor is so constructed that inside a housing where a refrigerant is present, a rotational motion of a swash plate mounted perpendicularly or obliquely on a rotational shaft by directly fixing the swash plate thereto or indirectly fixing the swash plate thereto through a coupling member to the rotational shaft is converted into a reciprocating motion of a piston through a semispherical shoe which slides on the swash plate to compress and expand the refrigerant. The swash plate compressor is classified into a double swash plate type of compressing and expanding the refrigerant at both sides of the swash plate by using a double head type piston and a single swash plate type of compressing and expanding the refrigerant at one side thereof by using a single head type piston. The semispherical shoe includes a type which slides on only one side surface of the swash plate and a type which slides on both side surfaces thereof. In these swash plate compressors, sliding having a high relative speed of not less 20*m* is generated per second on a sliding contact surface of the swash plate and that of the semispherical shoe. Thus the semispherical shoe is used in a very harsh environment.

In lubrication, lubricating oil circulates inside the housing, with the lubricating oil being blended into the refrigerant and diluted and is supplied to sliding contact portions in the form of mist. When an operation is resumed in an operation-suspended state, the lubricating oil is washed away by the vaporized refrigerant. As a result, when the operation is resumed, the sliding contact surface of the swash plate and that of the semispherical shoe have a dry lubricated state in which the lubricating oil is not supplied thereto. As a result, seizure is liable to occur As means for preventing the occurrence of the seizure, there is proposed the resin film consisting of polyether ether ketone (PEEK) directly formed on at least the sliding contact surface of the swash plate and that of the semispherical shoe by using an electrostatic powder coating method (see patent document 1). There is proposed the thermoplastic polyimide film containing the solid lubricant formed on the sliding contact surface by using the electrostatic powder coating method (see patent document 2).

To secure a high sliding property in high speed and high temperature conditions, there is proposed the sliding contact layer composed of the binder consisting of the PEEK resin and the solid lubricant dispersed in the binder. The sliding contact layer is formed on the sliding portion of at least one of the swash plate, the semispherical shoe, and the piston (see patent document 3).

PRIOR ART DOCUMENTS

Patent Documents

Patent document 1: Japanese Patent Application Laid-Open Publication No. 2002-180964

Patent document 2: Japanese Patent Application Laid-Open Publication No. 2003-049766

Patent document 3: Japanese Patent Application Laid-Open Publication No. 2002-039062

SUMMARY OF THE INVENTION

Problem to be Solved by the Invention

In the conventional arts, to improve the lubrication property of the swash plate and that of the semispherical shoe, methods of forming the sliding contact surface of the swash plate and that of the semispherical shoe of the lubricating film were proposed. Although the lubricating film was formed on the swash plate, the lubricating film has never been formed on the semispherical shoe in the conventional arts. As the reason for this, the sliding area of the semispherical shoe is smaller than that of the swash plate and in addition, the semispherical shoe is subjected to sliding contact with the spherical seat of the piston. Thus it is presumed that the durability of the lubricating film formed on the semispherical shoe cannot be sufficiently obtained owing to frictional heat.

According to the conventional arts, the entire surface of the semispherical shoe is covered with the resin film to allow the swash plate and the piston to allow the semispherical shoe to make sliding contact with the swash plate and the piston. Thereby the semispherical shoe has low performance in dissipating the frictional heat, and thus the temperature of the base material of the semispherical shoe rises. As a result, it may occur that the resin film melts. In addition, the formation of the resin film on the sliding contact surface by using the electrostatic powder coating method or by the application of a coating liquid causes the semispherical shoe to be subjected to a firing temperature. Thus there is a concern that the strength of the semispherical shoe deteriorates.

There is a problem that strict processing accuracy is demanded for flatness, parallelism, and thickness of the sliding contact surface of the swash plate having the lubricating film formed on the sliding contact surface thereof and that the swash plate cannot be produced at a low cost because the area of the lubricating film composed of an expensive material is large.

The present invention has been made to deal with the above-described problems. Therefore it is an object of the present invention to provide a semispherical shoe which can be prevented from being subjected to seizure even in a dry lubrication state in which there is no lubricating oil at the start time of an operation, does not deteriorate in its lubricating property owing to frictional heating, and ensures sufficient durability. It is another object of the present invention to provide a swash plate compressor in which a lubricating film is not formed on a sliding contact surface of a swash plate owing to the use of the semispherical shoe.

Means for Solving the Problem

In the present invention, a semispherical shoe for a swash plate compressor is so constructed that inside a housing where a refrigerant is present, a rotational motion of the swash plate mounted perpendicularly and obliquely on a rotational shaft by directly fixing the swash plate to the rotational shaft is converted into a reciprocating motion of a piston through a shoe which slides on the swash plate to compress and expand the refrigerant. A surface of a planar part of the semispherical shoe which makes sliding contact with the swash plate consists of a resin layer, and a surface of a spherical part consists of a base material of the semispherical shoe. In viewing the surface of the planar part of the resin layer divided into three parts consisting of a central part, an outer edge part, and an intermediate part interposed between the central part and the outer edge part in a direction vertical to the surface of the planar part, an annular belt portion whose layer thickness is larger than that of each of the central part and the outer edge part is formed inside the intermediate part.

A distance of the intermediate part from a center of the surface of the planar part is in a range of ⅕ to ⅘ of a diameter of the surface of the planar part; a distance of the central part from the center of the surface of the planar part is not more than ⅕ of the diameter of the surface of the planar part; and a distance of the outer edge part from the center of the surface of the planar part is not less than ⅘ of the diameter of the surface of the planar part.

A maximum layer thickness of the annular belt portion is set to not less than twice as large as a maximum layer thickness of each of the central part and the outer edge part.

An annular concave portion is formed on a surface, of a base material of the semispherical shoe, which contacts the intermediate part of the resin layer having an undercut structure.

The resin layer is formed by injection molding synthetic resin containing aromatic polyether ketone (PEK) resin as a main component thereof.

The swash plate compressor of the present invention is so constructed that inside a housing where a refrigerant is present, a rotational motion of the swash plate mounted perpendicularly and obliquely on a rotational shaft by directly fixing the swash plate to the rotational shaft is converted into a reciprocating motion of a piston through a semispherical shoe which slides on the swash plate to compress and expand the refrigerant. The semispherical shoe is the semispherical shoe of the present invention. A sliding contact surface of the swash plate which makes sliding contact with the semispherical shoe is a polished surface of a base material of the swash plate on which a lubricating film is not formed.

Effect of the Invention

In the semispherical shoe for the swash plate compressor of the present invention, the surface of the planar part which makes sliding contact with the swash plate consists of the resin layer. The surface of the spherical part consists of the base material of the semispherical shoe. Therefore even though frictional heat is generated owing to the sliding contact of the swash plate with the semispherical shoe, the semispherical shoe is excellent in dissipating the heat. Therefore even in a dry lubrication state at the start time of an operation, it is possible to prevent the resin layer from melting. In viewing the surface of the planar part of the semispherical shoe divided into three parts consisting of the central part, the outer edge part, and the intermediate part interposed between the central part and the outer edge part, the annular belt portion whose layer thickness is larger than that of each of the central part and the outer edge part is formed inside the intermediate part. Thereby the annular belt portion is capable of preventing the resin layer from peeling off the base material of the semispherical shoe when the surface of the planar part thereof makes sliding contact with the swash plate.

The distribution of the pressure applied to the planar part of the semispherical shoe in the sliding contact between the planar part thereof and the swash plate is lowest in the range (intermediate part) spaced at ⅕ to ⅘ of the diameter of the surface of the planar part from the center of the surface of the planar part. Therefore by making the thickness of the resin layer of the intermediate part larger than that of the resin layers of the other parts, it is possible to improve the adhesion between the base material of the semispherical shoe and the resin layer without deteriorating the heat dissipation performance of the resin layer. The distance of the intermediate part of the resin layer formed on the surface of the planar part of the semispherical shoe from the center of the surface of the planar part is in the range of ⅕ to ⅘ of the diameter of the surface of the planar part. The distance of the central part of the resin layer from the center of the surface of the planar part is not more than ⅕ of the diameter of the surface of the planar part. The distance of the outer edge part of the resin layer from the center of the surface of the planar part is not less than ⅘ of the diameter of the surface of the planar part. Therefore it is possible to improve the adhesion between the base material of the semispherical shoe and the resin layer and the peeling resistance of the resin layer to a higher extent. Further it is possible to secure the heat dissipation performance according to the pressure distribution. Furthermore by setting the layer thickness of the central part and outer edge part of the resin layer to 0.1 to 1 mm, it is possible to dissipate the frictional heat to the base material of the semispherical shoe.

The maximum layer thickness of the annular belt portion formed inside the intermediate part is set to not less than twice as large as the maximum layer thickness of each of the central part and the outer edge part. Thus the area of contact between the resin layer and the base material of the semispherical shoe is allowed to be large. Thereby the resin layer has an enhanced effect of dissipating the frictional heat. Further it is possible to improve the adhesion between the base material of the semispherical shoe and the resin layer and the peeling resistance of the resin layer to a higher extent.

The annular concave portion is formed on the surface, of the base material of the semispherical shoe, which contacts the intermediate part of the resin layer having an undercut structure. Therefore even though the resin layer separates from the base material of the semispherical shoe owing to the occurrence of an abnormal situation, it is possible to prevent the resin layer from peeling off the semispherical shoe.

Because the resin layer is formed by injection molding the synthetic resin containing the aromatic PEK resin as its main component, the resin layer is highly reliable. In addition, the above-described molding method eliminates the need for masking the resin layer and an extra production process and is thus capable of suppressing the rise of the cost.

Because the swash plate compressor of the present invention has the above-described semispherical shoe, the sliding contact surface of the semispherical shoe can be prevented from being subjected to seizure even in a dry lubrication state in which there is no lubricating oil at the start time of the operation thereof, does not deteriorate in its lubricating property owing to frictional heating, ensures high durability, is thus safe, and has a long life.

The sliding contact surface of the swash plate which makes sliding contact with the semispherical shoe used for the swash plate compressor consists of the polished base material of the swash plate and is not provided with the lubricating film. Therefore the present invention is capable of providing the swash plate compressor at low costs, although the swash plate compressor is functionally equivalent to conventional swash plate compressors.

MODE FOR CARRYING OUT THE INVENTION

Figure 1:
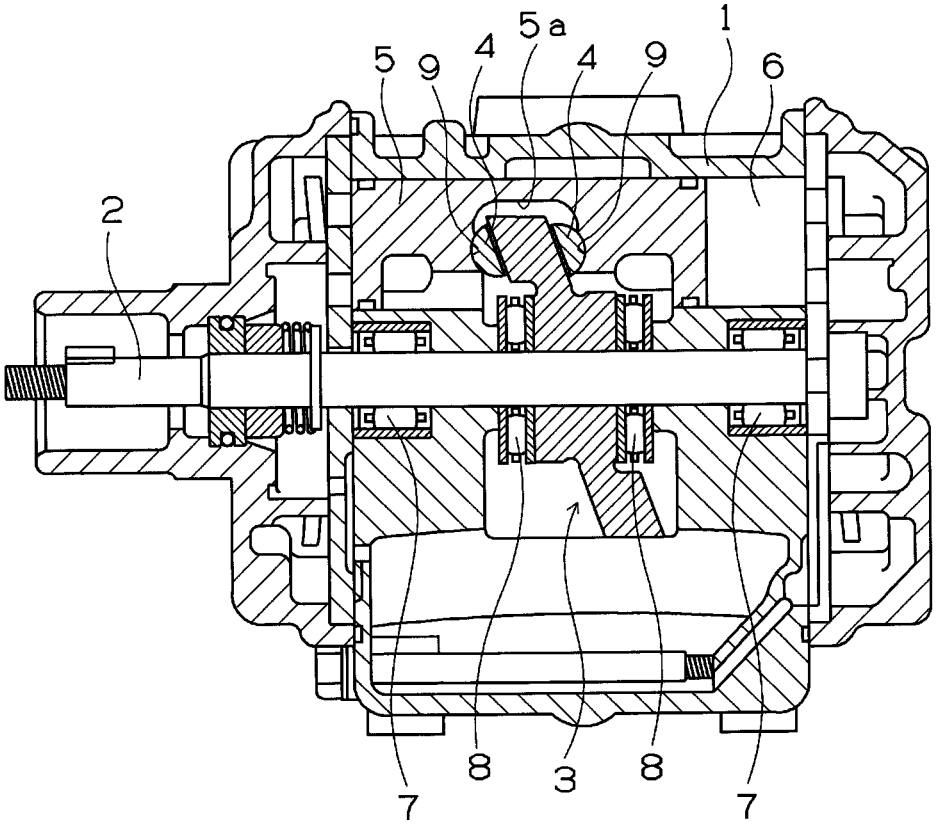
FIG. 1 is a vertical sectional view showing one example of a swash plate compressor of the present invention.

One embodiment of the swash plate compressor of the present invention is described below with reference to the drawings. FIG. 1 is a vertical sectional view showing one example of the swash plate compressor of the present invention. In the swash plate compressor shown in FIG. 1, carbon dioxide is used as a refrigerant. The swash plate compressor is a double swash plate type and is so constructed that inside a housing 1 where the refrigerant is present, a rotational motion of a swash plate 3 mounted obliquely on a rotational shaft 2 by directly fixing the swash plate 3 to the rotational shaft 2 is converted into a reciprocating motion of double head type pistons 5 through a semispherical shoe 4 which slides on both side surfaces of the swash plate 3 to compress and expand the refrigerant at both sides of each of the double head type pistons 5 disposed inside a cylinder bore 6 at regular intervals in the circumferential direction of the housing 1. The rotational shaft 2 to be driven at a high speed is supported by a needle roller bearing 7 in its radial direction and by a thrust needle roller bearing 8 in its thrust direction. The swash plate 3 may have a mode in which the swash plate 3 is indirectly fixed to the rotational shaft 2 via a coupling member. The swash plate 3 may also have a mode in which the swash plate 3 is mounted on the rotational shaft 2 not obliquely but perpendicularly thereto.

A concave portion 5*a* is formed on each piston 5 in such a way that the concave portion 5*a* strides over an outer peripheral portion of the swash plate 3. A semispherical shoe 4 is seated on a spherical seat 9 formed on a surface axially opposed to the concave portion 5*a* and supports the pistons 5 movably relative to the rotation of the swash plate 3. Thereby the rotational motion of the swash plate 3 can be smoothly converted into the reciprocating motions of the pistons 5. A spherical part 4*a* of the semispherical shoe 4 makes sliding contact with the pistons 5 (spherical seat 9), while a planar part thereof makes sliding contact with the swash plate 3.

Figure 2:
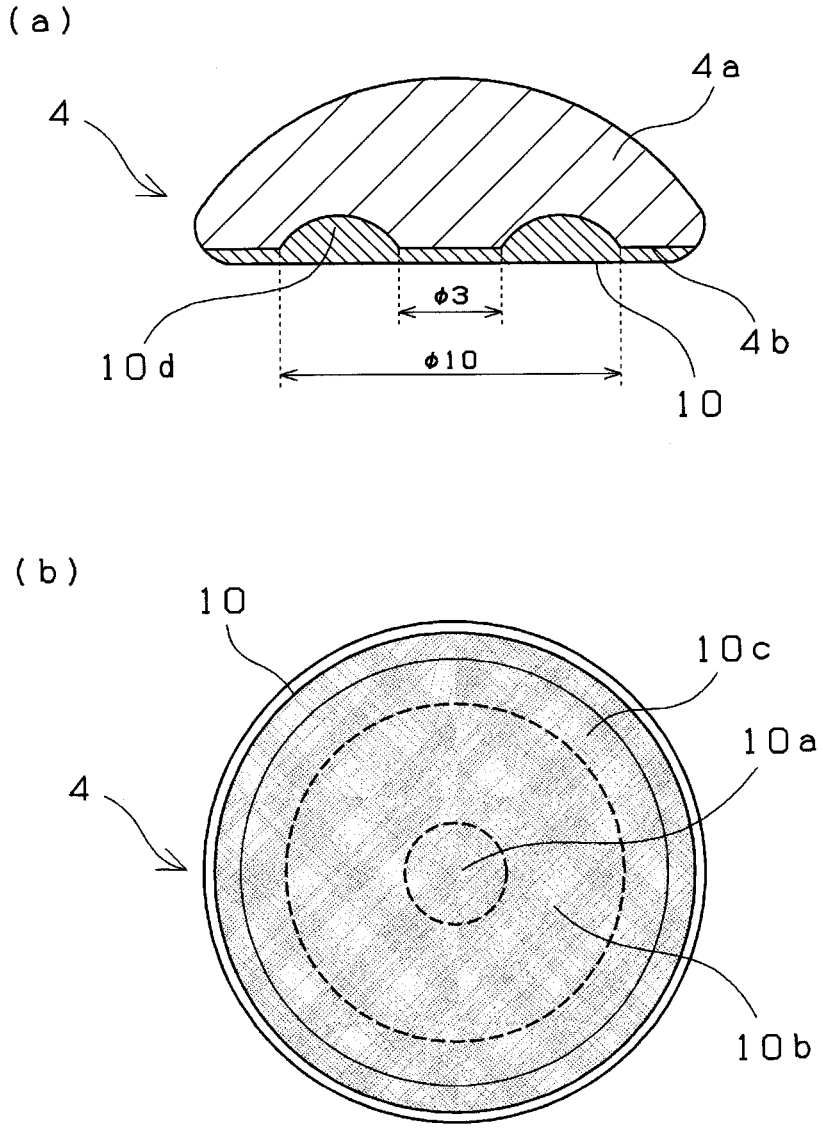
FIG. 2 is a sectional view and a plan view showing the semispherical shoe shown in FIG. 1 by enlarging the semispherical shoe.

The construction of the semispherical shoe is described in detail below with reference to FIG. 2. FIG. 2(*a*) is a vertical sectional view showing one example of the semispherical shoe of the present invention. FIG. 2(*b*) is a plan view. As shown in FIG. 2(*a*), the semispherical shoe 4 has an approximately semispherical construction composed of a spherical part 4*a* constituting a part of a sphere and a planar part 4*b* having a mode in which the sphere is cut planarly. A resin layer 10 is formed on the planar part 4*b*. The surface of the planar part 4*b* which makes the sliding contact with the swash plate is composed of the resin layer 10. The resin layer 10 is not formed on the surface of the spherical part 4*a*. Therefore the surface of the spherical part 4*a* which makes the sliding contact with the piston consists of a polished base material of the semispherical shoe. When frictional heat is generated owing to the sliding contact between the swash plate and the surface of the planar part, it is possible to escape the generated heat from the spherical part and thus prevent the resin layer from melting.

The base material of the semispherical shoe which can be used in the present invention is not specifically limited, provided that the base material is excellent in its mechanical strength and thermal conductivity. For example, metal materials such as steel, aluminum, aluminum alloys, copper, and copper alloys and ceramics are listed. As the steel materials, bearing steel (SUJ1 to SUJ5), chrome molybdenum steel, mechanical structural carbon steel, mild steel, stainless steel, and high-speed steel are listed. To decrease abrasive wear caused by the sliding contact between the semispherical shoe and the piston, the hardness of the surface of the semispherical shoe may be enhanced by subjecting these steel materials to treatment such as quenching. Of the above-described materials, it is preferable to use the bearing steel in view of reliability.

As the base material of the semispherical shoe, it is also possible to adopt sintered metals such as sintered iron-based, sintered copper-iron-based, copper-based, and stainless steel-based metals. It is preferable to use the sintered metal containing iron as its main component and the iron-based sintered metal containing not more than 10 wt % of copper, because these sintered metals are capable of enhancing the adhesion between the base material of the semispherical shoe and the resin layer. By using the sintered metal as the base material of the semispherical shoe, lubricating oil can be favorably retained on the surface of the spherical part and in addition, owing to an anchor effect provided by concave and convex portions formed on the surface of the planar part, it is possible to improve the adhesion of the resin layer to the base material of the semispherical shoe.

As shown in FIGS. 2(*a*) and 2(*b*), the resin layer 10 is a thin layer formed along the configuration of the surface of the planar part of the base material of the semispherical shoe and is circular in its planar configuration. In viewing the surface of the planar part divided into three parts consisting of three parts of a central part 10*a*, an outer edge part 10*c*, and an intermediate part 10*b* interposed between the central part 10*a* and the outer edge part 10*c* in a direction vertical to the surface of the planar part, an annular belt portion 10*d* whose layer is thicker than that of the central part 10*a* and that of the outer edge part 10*c* is formed inside the intermediate part 10*b*. The central part 10*a* is circular in its planar configuration, while the intermediate part 10*b* and the outer edge part 10*c* are donut-shaped in the planar configurations thereof. In the form shown in FIG. 2, the annular belt portion 10*d* is formed inside the entire intermediate part 10*b*. A concave portion complementary with the annular belt portion 10*d* is formed on a part of the planar part of the base material of the semispherical shoe. The surface of the resin layer 10 which makes the sliding contact with the swash plate is flat. The annular belt portion 10*d* is convex toward the spherical part and thicker than the central part 10*a* and the outer edge part 10*c*.

The intermediate part 10*b* is disposed in a range between a diameter of 3 mm and a diameter of 10 mm in relation to the center of the surface of the planar part (diameter: 13 mm). The central part 10*a* is disposed in a range at the inner side of the diameter of 3 mm. The outer edge part 10*c* is disposed in a range at the outer side of the diameter of 10 mm. The distribution of a pressure applied to the planar part in the sliding contact between the semispherical shoe and the swash plate is lowest in the range between the diameter of 3 mm and the diameter of 10 mm in relation to the center of the surface of the planar part. Therefore the frictional heat generation amount of the above-described range tends to be a little smaller than that of each of the other parts of the resin layer. Therefore even though the thickness of the resin layer of the intermediate part 10*b* is set partly or entirely larger than that of the resin layer of each of the central part 10*a* and the outer edge part 10*c*, the intermediate part 10*b* keeps the heat dissipation performance. In addition, because the area of contact between the base material of the semispherical shoe and the resin layer is large, the adhesion between the base material of the semispherical shoe and the resin layer is improved. It is desirable to chamfer the boundary between the intermediate part 10*b* and the central part 10*a* and the boundary between the intermediate part 10*b* and the outer edge part 10*c*. By chamfering the above-described boundaries, it is possible to prevent local wear of the resin layer disposed at the boundary between the intermediate part 10*b* and the central part 10*a* and local wear of the resin layer disposed at the boundary between the intermediate part 10*b* and the outer edge part 10*c*. The above-described boundaries may be C-chamfered or R-chamfered. A sufficient effect can be exhibited by chamfering the boundaries in a dimension of 0.3 to 1 mm in a planar part direction.

By forming the annular belt portion 10*d* whose layer thickness is larger than that of each of the central part 10*a* and the outer edge part 10*c* in the intermediate part 10*b* disposed in the range between the diameter of 3 mm and the diameter of 10 mm in relation to the center of the surface of the planar part, the adhesion between the base material of the semispherical shoe and the resin layer 10 is allowed to be higher, and thus the peeling resistance of the resin layer is improved. Consequently when the semispherical shoe makes the sliding contact with the swash plate, the annular belt portion 10*d* is capable of preventing the resin layer 10 from peeling off the base material of the semispherical shoe. Provided that the annular belt portion 10*d* having a large thickness is formed within the range of the intermediate part 10*b*, the annular belt portion 10*d* may be formed on the entire surface of the intermediate part 10*b* (for example, FIG. 2), closer to the central part 10*a*, closer to the outer edge part 10*c* or at the central portion of the intermediate part (for example, FIG. 3).

In FIG. 2 (*a*), the diameter of the surface of the planar part of the semispherical shoe 4 is set to 13 mm. In consideration of the diameter, the distance of the intermediate part 10*b* from the center of the surface of the planar part is set to a range of ⅕ to ⅘ of the diameter of the surface of the planar part. The distance of the central part 10*a* from the center of the surface of the planar part is set to not more than ⅕ of the diameter of the surface of the planar part. The distance of the outer edge part 10*c* from the center of the surface of the planar part is set to not less than ⅘ of the diameter of the surface of the planar part. By setting the relative disposition range of the parts of the planar part, as described above, it is possible to obtain a pressure distribution (the pressure distribution is lowest in the intermediate part) similar to that shown by the above-described specific range and obtain a similar effect.

It is favorable to set the layer thickness of the central part 10*a* and that of the outer edge part 10*c* to 0.1 mm to 1 mm. When the layer thicknesses thereof are smaller than 0.1 mm, it is difficult to form the resin layer by injection molding, and there is a fear that the wear resistance of the resin layer is insufficient. When the layer thicknesses of the central part 10*a* and that of the outer edge part are larger than 1 mm, the resin layer has a low performance in dissipating heat to the base material of the semispherical shoe. It is more favorable to set the layer thickness of the central part 10*a* and that of the outer edge part 10*c* to 0.15 mm to 0.5 mm. Although it does not matter whether the layer thickness of the central part 10*a* and that of the outer edge part 10*c* are equal to each other or slightly different from each other, it is advantageous in view of the productivity of the base material that both parts have an equal layer thickness.

It is preferable to set the maximum layer thickness of the annular belt portion 10*d* formed inside the intermediate part 10*b* to not less than twice as large as the maximum layer thickness of each of the central part 10*a* and the outer edge part 10*c*. By setting the maximum layer thickness of the annular belt portion 10*d* to the above-described range, the area of contact between the resin layer and the base material of the semispherical shoe is allowed to be large. Thereby the resin layer has an enhanced effect of dissipating the frictional heat and has a high adhesion to the base material of the semispherical shoe and thus has improved peeling resistance. The upper limit of the layer thickness of the intermediate part 10*b* is set to not more than ⅓ of the thickness of the portion of the base material of the semispherical shoe where the annular belt portion 10*d* is formed.

Figure 3:
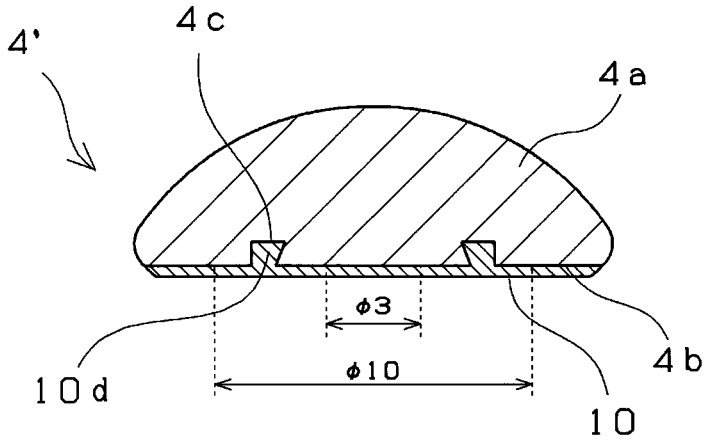
FIG. 3 is a vertical sectional view showing another example of the semispherical shoe.

Another embodiment of the semispherical shoe of the present invention is described below with reference to FIG. 3. FIG. 3 is vertical sectional view showing another example of the semispherical shoe. As shown in FIG. 3, in a semispherical shoe 4', an annular concave portion 4*c* is formed on the surface, of a base material of the semispherical shoe 4, which contacts the intermediate part of the resin layer 10 having an undercut structure. The undercut herein means a configuration which constitutes a three-dimensional obstacle when the resin layer moves toward a direction in which the resin layer separates from the base material of the semispherical shoe. It is possible to exemplify an upside down trapezoid such as a dovetail groove, a tapered inner periphery of the annular concave portion (FIG. 3), and a tapered outer periphery of the annular concave portion. More specifically, in FIG. 3, the inner diameter of the annular concave portion 4*c* at the lower surface side of the planar part of the base material of the semispherical shoe is set smaller than the inner diameter of the annular concave portion at the upper surface side of the planar part of the base material thereof.

After the resin layer is formed, the annular belt portion 10*d* in which resin has been filled in the annular concave portion 4*c* is formed. Owing to a three-dimensional engagement between the annular concave portion 4*c* formed on the surface of the base material of the semispherical shoe and the annular belt portion 10*d*, it is possible to prevent the resin layer from peeling off the base material of the semispherical shoe.

Although the method of forming the resin layer is not specifically limited, it is preferable to form the resin layer by insert molding of setting a semispherical shoe on which the resin layer has not been formed in a die and injection-molding synthetic resin on the semispherical shoe. The insert molding eliminates the need for masking and does not increase extra production processes. Thus it is possible to decrease the production cost.

To enhance the adhesion between the resin layer and the base material of the semispherical shoe, it is preferable to roughen the surface of the planar part of the base material of the semispherical shoe into a convex/concave configuration by subjecting the base material of the semispherical shoe to physical surface treatment such as shot blast, machining or the like before the resin layer is formed. It is also preferable to form a fine convex/concave configuration on at least the surface of the planar part by subjecting the surface of the planar part to chemical treatment such as acidic solution treatment (sulfuric acid, nitric acid, hydrochloric acid or mixtures of one or more of these acids and other solutions) or an alkaline solution treatment (sodium hydroxide, potassium hydroxide or one or more of these alkalis). The acidic solution treatment is preferable because it eliminates the need for performing masking treatment. The fine convex/concave configuration varies according to concentration, treatment period of time, post treatment. To enhance the adhesion between the resin layer and the base material of the semispherical shoe by the anchor effect, it is preferable to form fine concave and convex portions in which the pitch between adjacent concave portions is several to tens of nanometers on the surface of the planar part of the base material. Because the fine convex/concave configuration formed by the chemical surface treatment has a complicated three-dimensional structure like a porous structure, it is easy for the fine convex/concave configuration to produce the anchor effect and thus possible to strongly adhere the resin layer and the surface of the base material thereof to each other.

As synthetic resin to form the resin layer, synthetic resins which can be injection molded and are excellent in the lubrication property and heat resistance thereof are preferable. Examples of such synthetic resin include aromatic PEK resin, polyacetal (POM) resin, polyphenylene sulfide (PPS) resin, injection-moldable polyimide resin, polyamideimide (PAI) resin, polyamide (PA) resin, and injection moldable fluororesin. It is possible to use these synthetic resins singly or as polymer alloys by mixing not less than two kinds thereof with each other.

Of these synthetic resins, it is preferable to use the aromatic PEK resin as the main component of a mixture of a plurality of the synthetic resins. By using the aromatic PEK resin, it is possible to obtain the semispherical shoe excellent in its heat resistance, oil resistance, chemical resistance, creep resistance, and friction and wear properties and thus high in reliability. As the aromatic PEK resin which can be used in the present invention, polyether ether ketone (PEEK) resin, polyether ketone (PEK) resin, and polyether ether ketone ether ketone ketone (PEKEKK) resin are available. As commercially available PEEK resin which can be used in the present invention, VICTREX PEEK (90P, 150P, 380P, 450P, 90G, and 150G) produced by Victrex Inc., Keta Spire PEEK (KT-820P, KT-880P) produced by SOLVAY SPECIALTY POLYMERS JAPAN K.K., and VESTAKEEP (1000G, 2000G, 3000G, and 4000G) produced by Daicel-Evonik Ltd are listed. As the PEK resin, VICTREX HT produced by Victrex Inc. is exemplified. As the PEKEKK resin, VICTREX ST produced by Victrex Inc. is exemplified.

As the synthetic resin to form the resin layer, it is preferable add a solid lubricant such as polytetrafluoroethylene (PTFE) resin, graphite, molybdenum disulfide, and the like and a fibrous reinforcing material such as whiskers, aramid fibers, carbon fibers, and the like to the aromatic PEK resin to form a resin composition. The fibrous reinforcing agent and an inorganic solid lubricant (graphite, molybdenum disulfide, and the like) have an effect of decreasing the molding shrinkage factor of the aromatic PEK resin and thus have an effect of suppressing an increase of the internal stress of the resin layer when insert molding of integrating the synthetic resin with the base material of the semispherical shoe is performed. The solid lubricant allows the resin layer and the swash plate to make the sliding contact with low friction even in a condition in which the lubricating oil is diluted. Thus the occurrence of seizure can be prevented.

It is preferable that the melt viscosity of the synthetic resin to form the resin layer is 50 to 200 Pa·s when the temperature of resin is 380° C., and the shear velocity is 1000 $s^{-1}$. When the melt viscosity of the synthetic resin is in this range, it is possible to smoothly perform insert molding of integrating the synthetic resin having a thickness as small as 0.1 to 1.0 mm with the surface of the base material of the semispherical shoe. To allow the melt viscosity of the synthetic resin containing the aromatic PEK resin as its main component to have the above-described range, it is preferable to adopt the aromatic PEK resin whose melt viscosity in the above-described condition is not more than 150 Pa·s.

It is preferable to subject the surface of the resin layer (the surface of the planar part) which makes the sliding contact with the swash plate to polishing processing, after the resin layer is formed. Owing to the polishing processing, it is possible to prevent the generation of variation in the heights of the parts of the resin layer. Thereby the resin layer has a high dimensional accuracy. It is favorable to adjust the surface roughness of the resin layer to 0.1 to 1.0 μmRa (JIS B0601). By adjusting the surface roughness of the resin layer to the above-described range, the true area of contact of the sliding contact surface of the resin layer which makes the sliding contact with the swash plate is large. Thus it is possible to reduce the actual surface pressure to be applied to the sliding contact surface and prevent the occurrence of seizure. When the surface roughness of the resin layer is less than 0.1 μmRa, the amount of the lubricating oil to be supplied to the sliding contact surface is short. When the surface roughness of the resin layer exceeds 1.0 μmRa, the true area of contact of the sliding contact surface of the resin layer becomes low. As a result, the surface pressure applied to the resin layer becomes locally high and thereby seizure is liable to occur. It is more favorable to adjust the surface roughness of the resin layer to 0.2 to 0.8 μmRa To supplement a lubrication action at a thin lubricating condition, oil pockets may be formed on the surface of the resin layer (the surface of the planar part) which makes the sliding contact with the swash plate. As the form of the oil pockets, speckled or streaky concave portions are exemplified. As the speckled or streaky configuration, parallel linear, lattice, spiral, radial, and annular configurations are listed. It is preferable to form the oil pockets when an injection molding is performed. The depth of each oil pocket can be appropriately determined in a thickness less than the thickness of the resin layer. By forming an annular groove or the like in accordance with the position of the annular belt portion formed inside the intermediate part of the resin layer, it is possible to allow the resin layer to have a thickness not less than a predetermined thickness over the entire sliding contact surface in forming the oil pockets on the surface thereof. A dynamic pressure groove may be formed on the surface of the resin layer (the surface of the planar part) which makes the sliding contact with the swash plate.

The swash plate compressor in which the semispherical shoe of the present invention is used is so constructed that inside the housing where the refrigerant is present, the rotational motion of the swash plate mounted perpendicularly and obliquely on the rotational shaft by directly fixing the swash plate to the rotational shaft is converted into the reciprocating motion of the piston through the semispherical shoe which slides on the swash plate to compress and expand the refrigerant. By using the semispherical shoe of the present invention for the swash plate compressor, it is unnecessary to form the lubricating film on the swash plate which makes the sliding contact with the semispherical shoe. That is, it is possible to incorporate the swash plate in the swash plate compressor in a state where the surface of the swash plate consists of the polished base material and allow the swash plate to make the sliding contact with the semispherical shoe. Therefore the present invention is capable of providing the swash plate compressor at low costs, although the swash plate compressor is functionally equivalent to conventional swash plate compressors. As the base material of the swash plate, it is possible to adopt steel materials such as mechanical structural carbon steel (S45C), a hot-rolled steel plate for automotive structure (SAPH440), spheroidal graphite cast iron steel (FCD), and copper alloys.

INDUSTRIAL APPLICABILITY

The semispherical shoe for the swash plate compressor of the present invention can be prevented from being subjected to seizure even in a dry lubrication state in which there is no lubricating oil at the start time of an operation starts, is not deteriorated in its lubricating property by frictional heating, and ensures sufficient durability. Therefore the semispherical shoe can be utilized for various types of swash plate compressors. Particularly the semispherical shoe can be suitably utilized for swash plate compressors, developed in recent years, which are used in a high speed and high load specification to compress and expand a refrigerant consisting of carbon dioxide or HFCl234yf.

EXPLANATION OF REFERENCE NUMERALS AND SYMBOLS

1: housing
2: rotational shaft
3: swash plate
4, 4': semispherical shoe
4*a*: spherical part
4*b*: planar part
4*c*: annular concave portion
5: piston
5*a*: concave portion
6: cylinder bore
7: needle roller bearing
8: thrust needle roller bearing
9: spherical seat
10: resin layer
10*a*: central part
10*b*: intermediate part
10*c*: outer edge part
10*d*: annular belt portion

The invention claimed is:

1. A semispherical shoe for a swash plate compressor so constructed that inside a housing where a refrigerant is present, a rotational motion of said swash plate mounted perpendicularly and obliquely on a rotational shaft by directly fixing said swash plate to said rotational shaft is converted into a reciprocating motion of a piston through a shoe which slides on said swash plate to compress and expand said refrigerant, wherein a surface of a planar part of said semispherical shoe which makes sliding contact with said swash plate consists of a resin layer, and a surface of a spherical part consists of a base material of said semispherical shoe; and in viewing said surface of said planar part of said resin layer divided into three parts consisting of a central part, an outer edge part, and an intermediate part interposed between said central part and said outer edge part in a direction vertical to said surface of said planar part, an annular belt portion whose layer thickness is larger than that of each of said central part and said outer edge part is formed inside said intermediate part.

2. A semispherical shoe for a swash plate compressor according to claim 1, wherein a distance of said intermediate part from a center of said surface of said planar part is in a range of ⅕ to ⅘ of a diameter of said surface of said planar part; a distance of said central part from said center of said surface of said planar part is not more than ⅕ of said diameter of said surface of said planar part; and a distance of said outer edge part from said center of said surface of said planar part is not less than ⅘ of said diameter of said surface of said planar part.

3. A semispherical shoe for a swash plate compressor according to claim 1, wherein a maximum layer thickness of said annular belt portion is set to not less than twice as large as a maximum layer thickness of each of said central part and said outer edge part.

4. A semispherical shoe for a swash plate compressor according to claim 1, wherein an annular concave portion is formed on a surface, of a base material of said semispherical shoe, which contacts said intermediate part of said resin layer having an undercut structure.

5. A semispherical shoe for a swash plate compressor according to claim 1, wherein said resin layer is formed by injection molding synthetic resin containing aromatic polyether ketone resin as a main component thereof.

6. A swash plate compressor so constructed that inside a housing where a refrigerant is present, a rotational motion of said swash plate mounted perpendicularly and obliquely on a rotational shaft by directly fixing said swash plate to said rotational shaft is converted into a reciprocating motion of a piston through a semispherical shoe which slides on said swash plate to compress and expand said refrigerant, wherein said semispherical shoe is as claimed in claim 1.

7. A swash plate compressor according to claim 6, wherein a sliding contact surface of said swash plate which makes sliding contact with said semispherical shoe is a polished surface of a base material of said swash plate on which a lubricating film is not formed.

* * * * *